US008256336B2

(12) United States Patent
Larkin et al.

(10) Patent No.: US 8,256,336 B2
(45) Date of Patent: Sep. 4, 2012

(54) SYSTEM FOR DISABLING SMALL WATER CRAFT

(75) Inventors: Louis J. Larkin, Palm Beach Gardens, FL (US); Katherine L Janney, Palm Beach Gardens, FL (US); Richard P Clark, Jupiter, FL (US)

(73) Assignee: Lockheed Martin Corporation, Bethesda, MD (US)

( * ) Notice: Subject to any disclaimer, the term of this patent is extended or adjusted under 35 U.S.C. 154(b) by 169 days.

(21) Appl. No.: 12/769,584

(22) Filed: Apr. 28, 2010

(65) Prior Publication Data

US 2010/0269675 A1 Oct. 28, 2010

Related U.S. Application Data

(60) Provisional application No. 61/173,267, filed on Apr. 28, 2009, provisional application No. 61/174,249, filed on Apr. 30, 2009.

(51) Int. Cl.
*B63G 8/28* (2006.01)

(52) U.S. Cl. ..... 89/1.11; 114/316

(58) Field of Classification Search ..... 89/1.11; 114/316, 317, 318, 319, 241, 240 C, 240 E, 114/382; 43/7
See application file for complete search history.

(56) References Cited

U.S. PATENT DOCUMENTS

| | | | | |
|---|---|---|---|---|
| 2,353,360 | A * | 7/1944 | Ronning | 244/1 R |
| 2,693,161 | A * | 11/1954 | Stubbs | 405/71 |
| 5,675,116 | A * | 10/1997 | Hillenbrand | 114/21.2 |
| 6,325,015 | B1 * | 12/2001 | Garcia et al. | 114/382 |
| 6,600,695 | B1 * | 7/2003 | Nugent et al. | 367/131 |
| 2001/0032577 | A1 * | 10/2001 | Swartout et al. | 114/254 |
| 2005/0016372 | A1 * | 1/2005 | Kilvert | 89/1.34 |
| 2007/0017432 | A1 * | 1/2007 | Farinella et al. | 114/382 |
| 2009/0020062 | A1 * | 1/2009 | Fong et al. | 114/253 |
| 2009/0090286 | A1 * | 4/2009 | Korolenko et al. | 114/5 |

* cited by examiner

*Primary Examiner* — Bret Hayes

(74) *Attorney, Agent, or Firm* — Kaplan Breyer Schwarz & Ottesen LLP

(57) ABSTRACT

A system and method for disabling a small boat comprises at least two hulls and an entanglement device disposed therebetween. In the illustrative embodiment, each hull is an unmanned underwater vehicle. The system is launched from a vessel to intercept the small boat. When close to the small boat, the separating distance between the two hulls is increased, thereby deploying the entanglement device and causing it to become entangled with the small boat (e.g., the small boat's propulsion system, etc.).

19 Claims, 10 Drawing Sheets

SYSTEM FOR DISABLING SMALL WATER CRAFT

STATEMENT OF RELATED CASES

This case claims priority of the following U.S. Provisional Patent Application Ser. Nos. 61/173,267 filed Apr. 28, 2009 and 61/174,249 filed Apr. 30, 2009. Both of these applications are incorporated by reference herein.

FIELD OF THE INVENTION

The present invention relates to means for disabling small water craft, such as are often used for hijacking or terrorist operations.

BACKGROUND OF THE INVENTION

Small watercraft can pose a hazard to commercial shipping and even naval ships. Regarding the former, Somali pirates have disrupted commercial shipping in the Gulf of Aden and even into the Indian Ocean. In 2008, these pirates collected in excess of $150 M in ransom from hijacked ship owners. The pirates use small craft to assault the ship; grappling hooks are used to secure lines, board the ship and seize control. Since modern merchant ships are highly automated, there are typically only small crews for onboard for defense. This enables pirates to easily overpower the crew and operate the ship after hijacking.

When maneuvering in restricted conditions, moored, or at anchor, naval vessels are particularly vulnerable to attack from a group of small, fast boats. Due to their size, speed, and maneuverability, these small boats can attack and then run and hide from larger navy vessels. To make matters worse, hostiles will often be operating in their own waters where they will typically enjoy a significant numerical advantage and superior knowledge of the waterways. This type of attack, which is referred to as a "small-boat-swarm," is the tactic of choice for terrorists.

There are no truly cost-effective options for addressing the piracy issue. The naval response to small-boat-swarm has been to deploy similarly-sized, stealthy, fast, heavily-armed craft. An appropriately outfitted Zodiac-type raft has been used for this service. But even highly-trained navy personnel have a limited capability to withstand the repeated shock to their bodies that occurs when traveling in such craft at high speed in moderately high sea states.

SUMMARY OF THE INVENTION

The present invention provides a cost effective and non-lethal way to disable a small boat, such as used by pirates or terrorists. In accordance with the illustrative embodiment of the invention, a system for disabling a small boat comprises (1) two hulls, (2) a propulsion subsystem, (3) a homing, guidance, and control subsystem, (4) a depth-control subsystem, and (5) an entanglement device, typically comprising a long, stranded material that is neutrally or positively buoyant, suitably strong to be deployed by the moving hulls and not capable of being shredded by a prop.

The system, which is relatively small, is maintained aboard a commercial or naval vessel. If a small craft is detected by ships' crew or on-board sensors, and if it is determined or likely that operators of the small craft have malicious intent, the system is deployed in the water.

The homing, guidance, and control subsystem acquires the target and causes the propulsion subsystem to move the system toward the small craft. As the system nears the target, the entanglement device is deployed. The entanglement device is deployed by increasing the distance between the two hulls, thereby causing the net, etc., to spread out near the surface of the water.

The intent of the entanglement device is, as its name suggests, to become entangled with the target craft. As previously noted, the entanglement device is a neutrally or positively buoyant, long, stranded material. In some embodiments, the entanglement device is a neutrally or positively buoyant net of monofilament construction and includes a plurality of strands of fibrous material that extend from net. If the small craft is propeller driven, the net or strands become entangled with the prop or other protruding features of the craft. If the small craft is a jet boat, the strands of fibrous material will be ingested into the jet intakes. In either case, the small craft will be incapacitated and rendered motionless in the water.

Assuming that the small boat is disabled at an acceptable standoff distance (several hundred meters, etc.) from the ship, its mission will be frustrated. For example, in the case of attempted piracy, the pirates will be prevented from boarding and there will be ample time for the commercial ship to escape and radio for help. Or, if the encounter is with a naval vessel, the small boat will not be able to approach the hull to place explosives or perpetuate other acts of sabotage. And the naval vessel can respond as appropriate.

Since the system is non-lethal, it presents decreased safety risks for the crew. Furthermore, if the system is deployed against what turns out to be a non-hostile target, there will be no loss of life and any potential liability will be significantly reduced. The system is intended to be disposable, so a relatively minimal level of sophistication in terms of tracking, guidance, and control systems is desirable.

In some embodiments, the two hulls are small, unmanned underwater vehicles ("UUVs"). In such embodiments, the propulsion subsystem, homing, guidance, and control subsystem, depth-control subsystem (typically a ballasting system), and propulsion subsystem will be onboard each UUV.

In some other embodiments, one or both of the hulls is powered (i.e., propulsion hulls), but they are not autonomous in the sense of a UUV. In such embodiments, the two hulls are typically each coupled via movable linkages to a third hull, which can house the homing, guidance, and control subsystem. These embodiments incorporate a mechanism for reconfiguring the linkages, which changes the separation distance between the hulls to deploy the entanglement device.

In still further embodiments, the hulls are not powered; rather they are attached to a third hull that incorporates a propulsion subsystem and a homing, guidance, and control subsystem. The hulls typically include the depth-control subsystem (e.g., a ballasting system, etc.).

DETAILED DESCRIPTION

The illustrative embodiment of a system for disabling small watercraft comprises:

- two hulls, wherein the separation distance between the hulls can be changed;
- a way to propel and guide the hulls through water to a target;
- an ability to float or submerge;
- an entanglement device for disabling the target.

This system can be implemented in a variety of ways, a few of which are described herein and depicted in the accompanying drawings.

Figure 1:
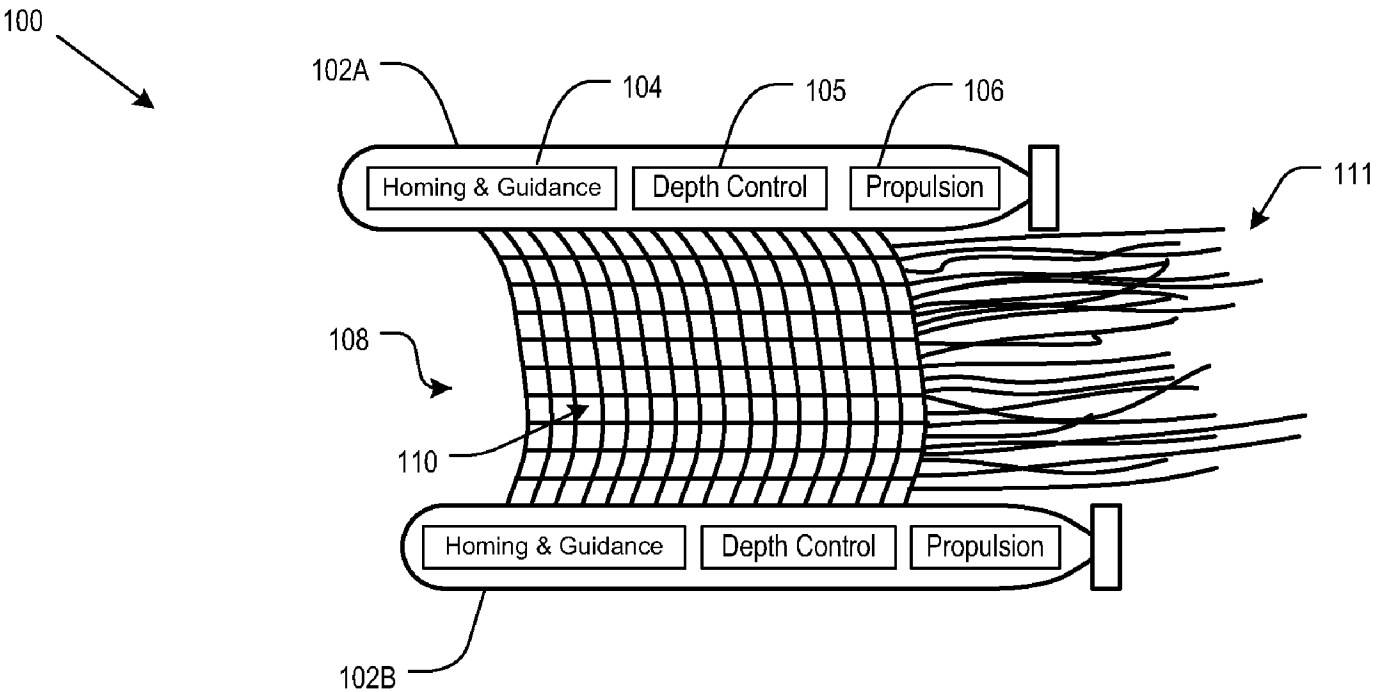
FIG. 1 depicts system 100 in accordance with the illustrative embodiment for disabling small watercraft.

FIG. 1 depicts system 100, which is first embodiment of a system for disabling small watercraft. In system 100, the two hulls are realized as UUVs 102A and 102B. Entanglement device 108 is coupled to UUVs 102A and 102B.

UUVs 102A and 102B can be any one of a number of available UUVs, including, without limitation, Mk 39 EMATT, SUBMATT, as available from Lockheed Martin, or other suitable UUVs. Each UUV includes homing, guidance, and control subsystem 104, depth-control subsystem 105, and propulsion subsystem 106.

In some embodiments, homing, guidance, control subsystem 104 comprises passive and/or active sensors for acquiring the small craft and a processor running software capable of estimating a trajectory of the small craft and/or an intercept trajectory. Having acquired the position of the small craft, the guidance system issues commands, for example, to the propulsion systems of UUV 102A and 102B to propel system 100 toward the target. It will be appreciated by those skilled in the art that any one of a number of approaches to acoustic tracking, guidance, and control can be used for homing, guidance, and control system 104. It is within the capabilities of those skilled in the art to design and implement such systems.

In the illustrative embodiment, depth-control subsystem 105 is a conventional ballasting system, well known to those skilled in the art. Propulsion subsystem 106 comprises an electrically-driven propulsor or water jet, or other thrust-generating systems suitable for propelling UUVs, as a function of their size.

In accordance with the illustrative embodiment, entanglement device 108 comprises net 110 (e.g., monofilament, etc.) having fibrous "streamers" 111 extending therefrom. In some embodiments, streamers 111 comprise a plurality of elongated strands of fibrous material, each of which strands has a length that is typically in the range of about 1 to 4 meters. Entanglement device 108 need not be a net, per se; it can take any form that is suitable for disabling the propulsion system (e.g. entangling the propellers or other external features, fouling the intakes of a jet-propelled craft, etc.) of a target.

Operation of a system for disabling a small craft, such as system 100, is now described in conjunction with FIGS. 2A through 2D and FIG. 6.

Figure 2A:
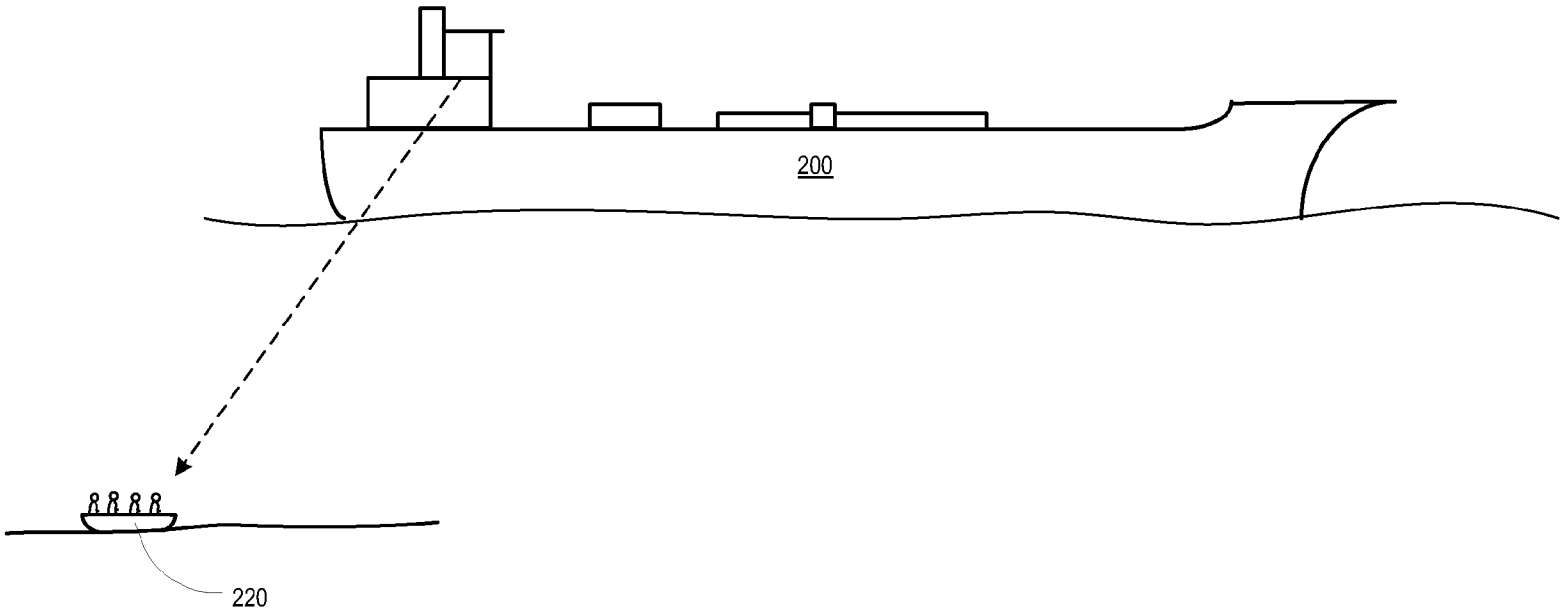
FIGS. 2A-2D depict system 100 of FIG. 1 in use.

FIG. 2A depicts small craft 220 approaching vessel 200, which in this embodiment is depicted as being commercial shipping vessel 200. A crew member aboard vessel 200 is alerted to the presence of craft 220.

Figure 2B:
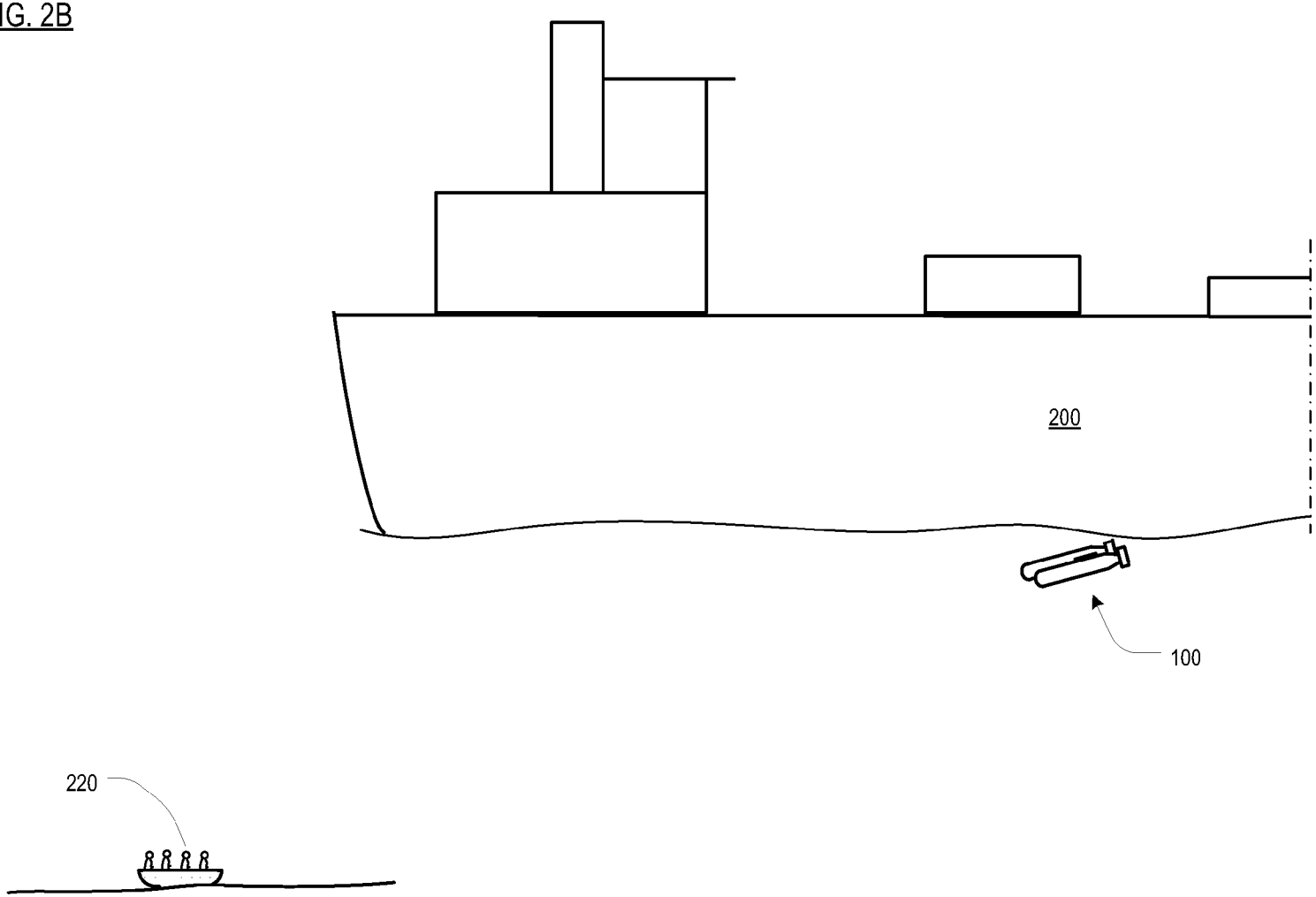

In response, the crew of the commercial vessel deploys system 100 into the water, as depicted in FIG. 2B. See also, FIG. 6, operation 601, which recites "deploying two hulls in the water." In some embodiments, system 100 is simply lowered over the side of the vessel 200. In some other embodiments, vessel 200 includes special adaptations for a more-stealthy launch of system 100, such as a towing cradle, etc., that keeps system 100 submerged. Such adaptations, which can also include below-the-waterline storage bays (see, e.g., FIG. 5), would more typically be used in conjunction with a naval vessel.

Once in the water, acoustic sensors associated with system 100 acquire craft 220 and develop trajectory estimates and an intercept solution. See also, FIG. 6, operation 603, which recites "estimating a location of a target."

System 100 then transits toward target 220 in accordance with trajectory/intercept estimates. See also, FIG. 6, operation 605, which recites "transiting the hulls to the target." In a preferred mode of operation, system 100 dives to maintain stealth and then transits toward craft 220.

Figure 2C:
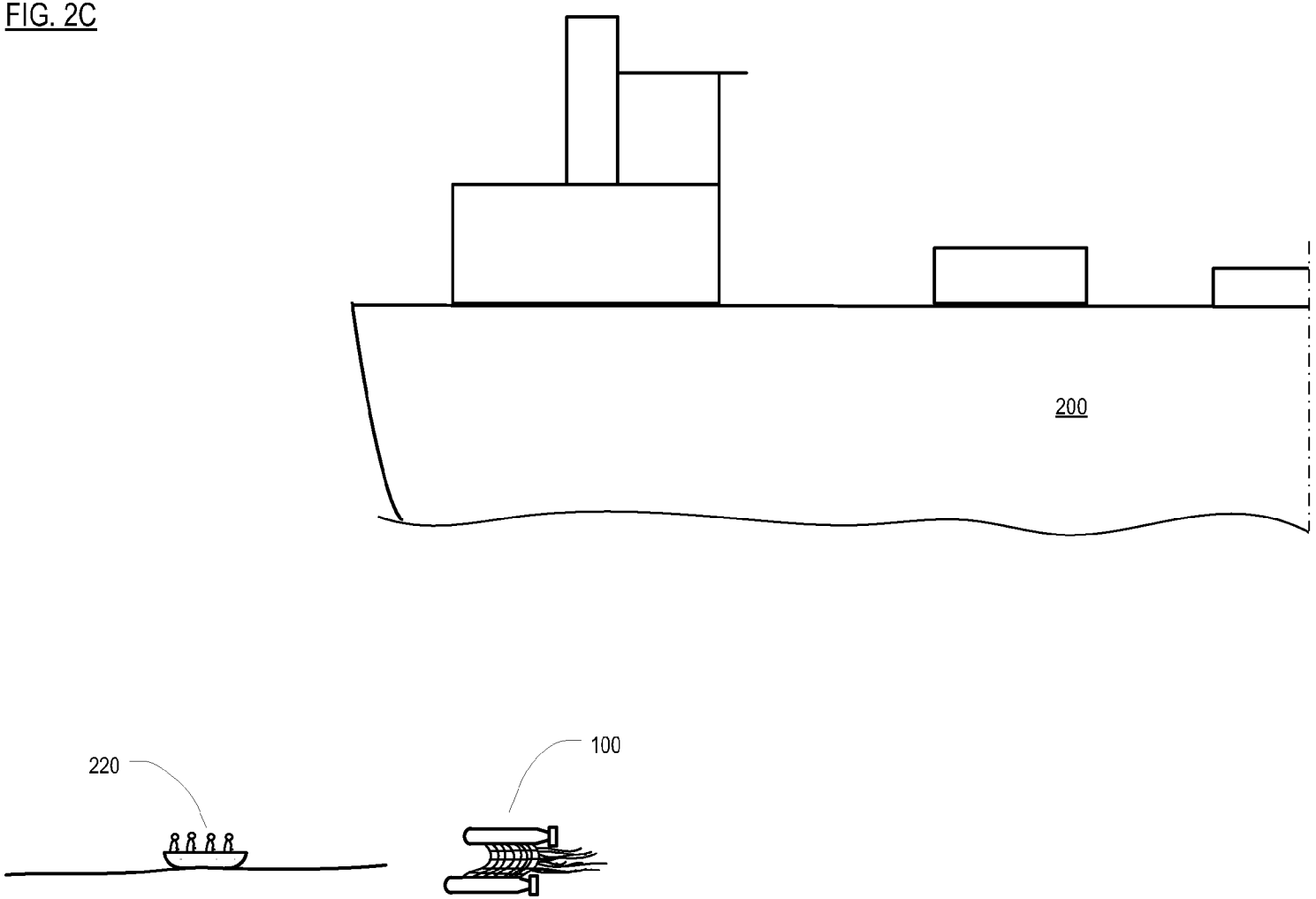

As system 100 approaches target 220, it surfaces. After surfacing, or just prior to surfacing, and in response to a command from a human operator or in accordance with system programming, UUVs 102A and 102B increase their separation distance, thereby deploying entanglement device 108 as depicted in FIG. 2C. See also, FIG. 6, operation 607, which recites "deploying an entanglement device by increasing a lateral separation between the two hulls."

Figure 2D:
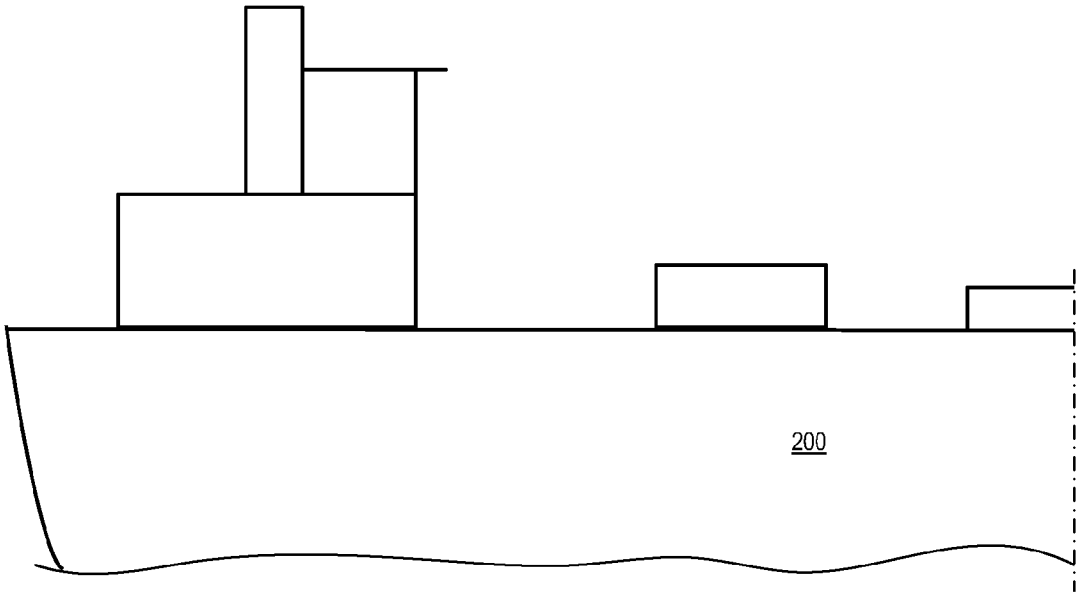
Figure 2D:
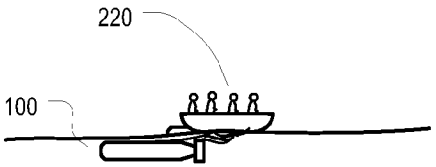

With entanglement device 108 deployed (e.g., net with streamers, etc.), system 100 engages target 220, as depicted in FIG. 2D. The small craft becomes tangled in the net and the streamers snare the prop of the small craft or foul its jet intakes, whichever is present. See also, FIG. 6, operation 609, which recites "causing the entanglement device to become entangled with a portion of the target."

In some further embodiments, more than one instance of system 100 is used. The use of a relatively larger number of these systems increases the potential reach of entangling device 108 and, of course, is required when the attacking force includes plural small watercraft.

FIGS. 3A through 3D depict system 300, which is an alternative embodiment of system 100 depicted in FIG. 1. One significant difference between system 300 and system 100 is that in system 300, hulls 302A and 302B are not UUVs. At least one of hulls 302A and 302B is a propulsion hull (i.e., includes a propulsion subsystem), but neither of these hulls function autonomously in the manner of a UUV, such as UUVs 102A and 102B.

Figure 3A:
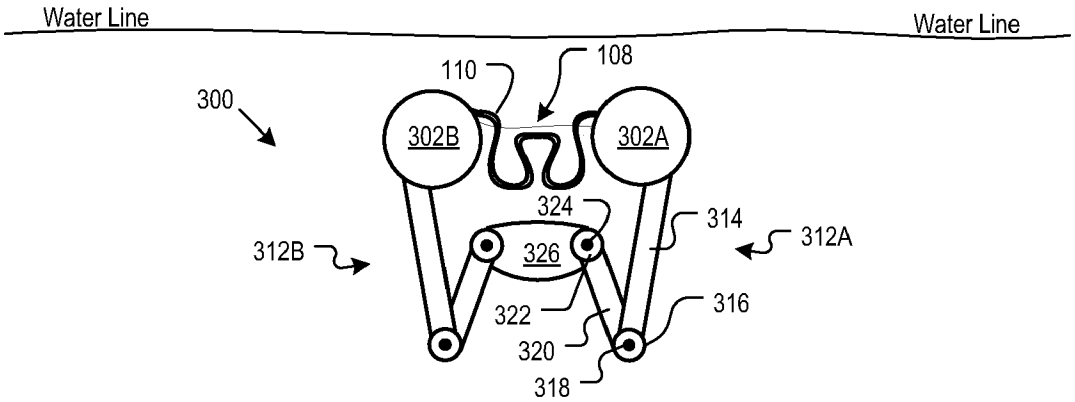
FIGS. 3A-3D depict a first alternative embodiment of system 100.
Figure 3B:
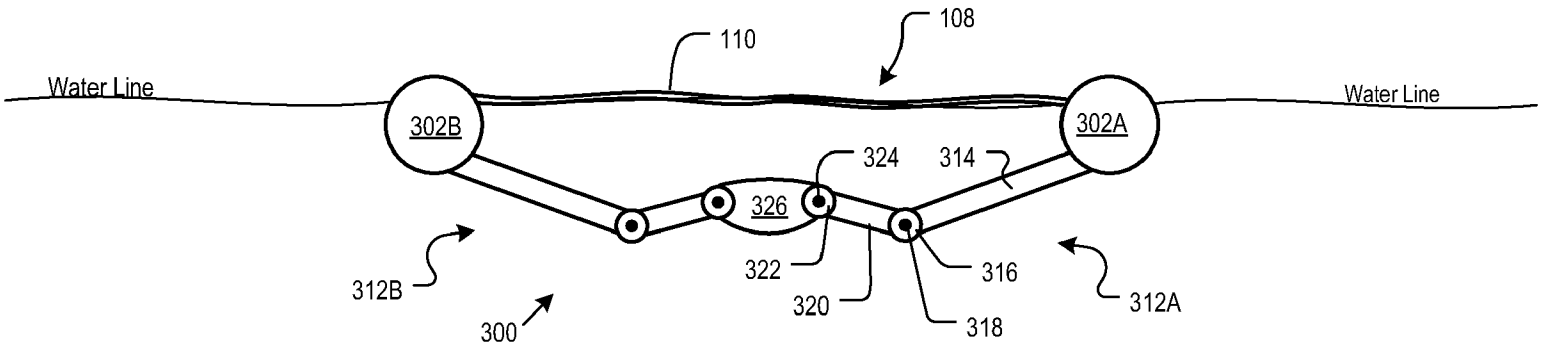
Figure 3C:
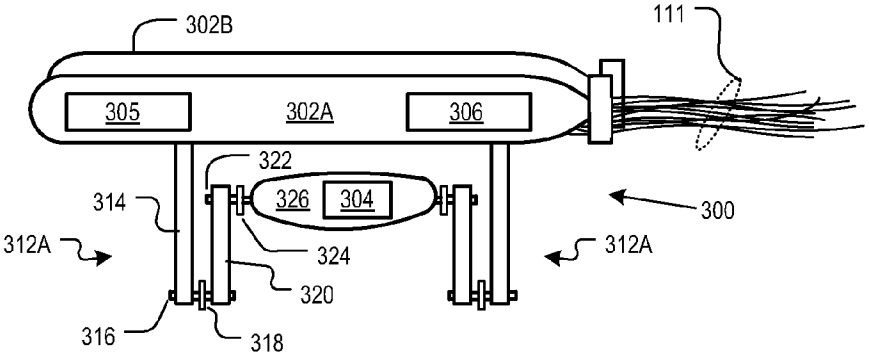
Figure 3D:
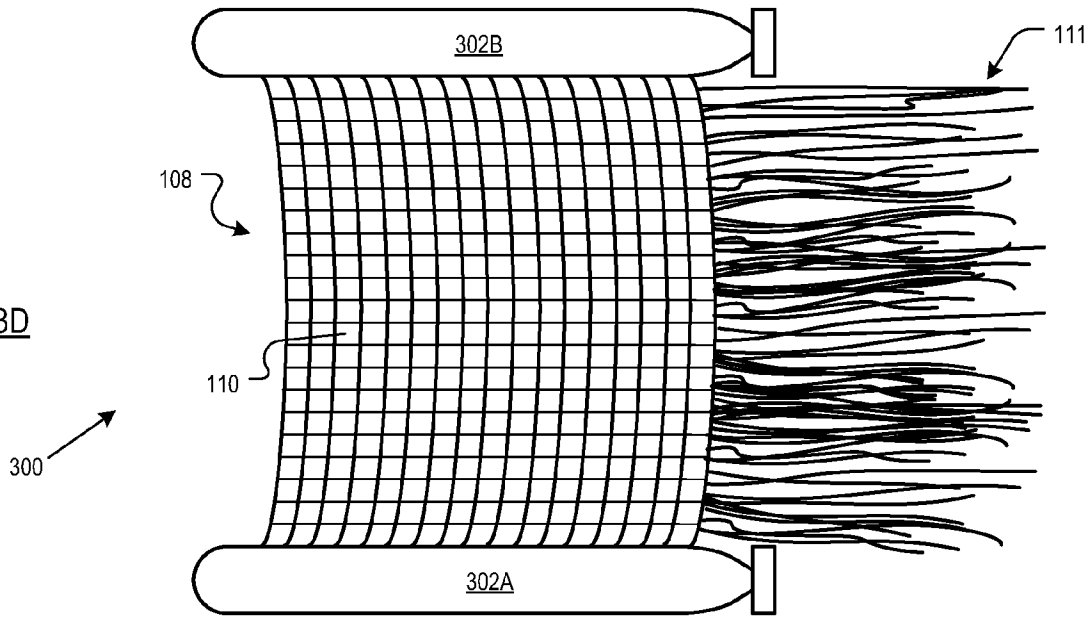

Referring now to FIGS. 3A through 3D, FIG. 3A depicts a front view of system 300 wherein entanglement device 108 is not deployed, FIG. 3B depicts the same view as FIG. 3A but with entanglement device 108 deployed, FIG. 3C depicts a side view of system 300 in the same state as in FIG. 3A, and FIG. 3D depicts a top view of system 300 in the same state as in FIG. 3B. For clarity, streamers 111 are not depicted in FIGS. 3A and 3B and the various linkages and other structure beneath entanglement device 108 are not depicted in FIG. 3D.

System 300 comprises hulls 302A and 302B, secondary hull 326, linkages 312A and 312B, and entanglement device 108, interrelated as shown.

With particular reference to FIGS. 3A and 3B, linkage 312A couples hull 302A to secondary hull 326. Likewise, linkage 312B couples hull 302B to secondary hull 326. As will be evident from FIG. 3C, system 300 includes two sets (one forward, one rear) of 312A linkages (for coupling to hull 302A) and two sets of 312B linkages (for coupling to hull 302B). Only the forward 312A and 312B linkages are depicted in FIGS. 3A and 3B and neither forward nor rear 312B linkages are depicted in FIG. 3C.

In the embodiment of system 300 depicted in FIGS. 3A through 3D, linkages 312A and 312B are articulated or jointed. That is, pivot point 316 rotatably couples linkage member 314 to linkage member 320 and pivot point 322 rotatably couples linkage member 320 to secondary hull 324.

Linkages 312A and 312B are capable of reconfiguring to change the separation distance between hulls 302A and 302B by allowing the linkage members to partially rotate relative to one another. Compare, for example, FIG. 3A to FIG. 3B; the separation between hulls 302A and 302B is greater in FIG. 3B than in FIG. 3A. To achieve this increased separation, the angle between linkage member 320 and secondary hull 324 is increased and the angle between linkage members 320 and 314 is increased. And with the increased separation shown in FIG. 3B, entanglement device 108 deploys.

System 300 includes a mechanism or arrangement for reconfiguring linkages 312A and 312B. In the embodiment depicted in FIGS. 3A through 3B, the mechanism comprises spring-biasing devices 318 and 324. The spring-biasing devices are arranged with respect to linkage members 314 and 320 such that in the absence of some restraint, device 318 causes member 314 to rotate away from member 320. Device 324 causes linkage member 320 to rotate away from secondary hull 326. In some embodiments, the restraint is a latch or similar mechanism (not depicted) that, when engaged, maintains linkages 312A and 312B in their "stowed" or non-extended state (as in FIG. 3A). When homing, guidance, and control system 104 determines that system 300 is in the vicinity of the target and entanglement device 108 is to be deployed, the subsystem sends a signal to an actuator (not depicted) to move the latch, thereby freeing linkage members 314 and 320. Once the linkage members are freed, the potential energy stored in spring biasing devices 318 and 324 can be released, resulting in the rotation of the linkages members, as previously described.

In conjunction with the present disclosure, those skilled in the art will be able to design and incorporate any one of a variety of mechanisms suitable for accomplishing the above-described functionality (i.e., reconfiguring linkages 312A and 312B). It is notable that for most contemplated uses, it is not necessary for linkages 312A and 312B to be able to autonomously return to their stowed after entanglement device 108 is deployed. After successful deployment and immobilization of a target, system 300 can be reset manually after recovery, to the extent recovery is desired. That is, with its relatively low cost, system 300 can be considered to be disposable.

Figure 6:
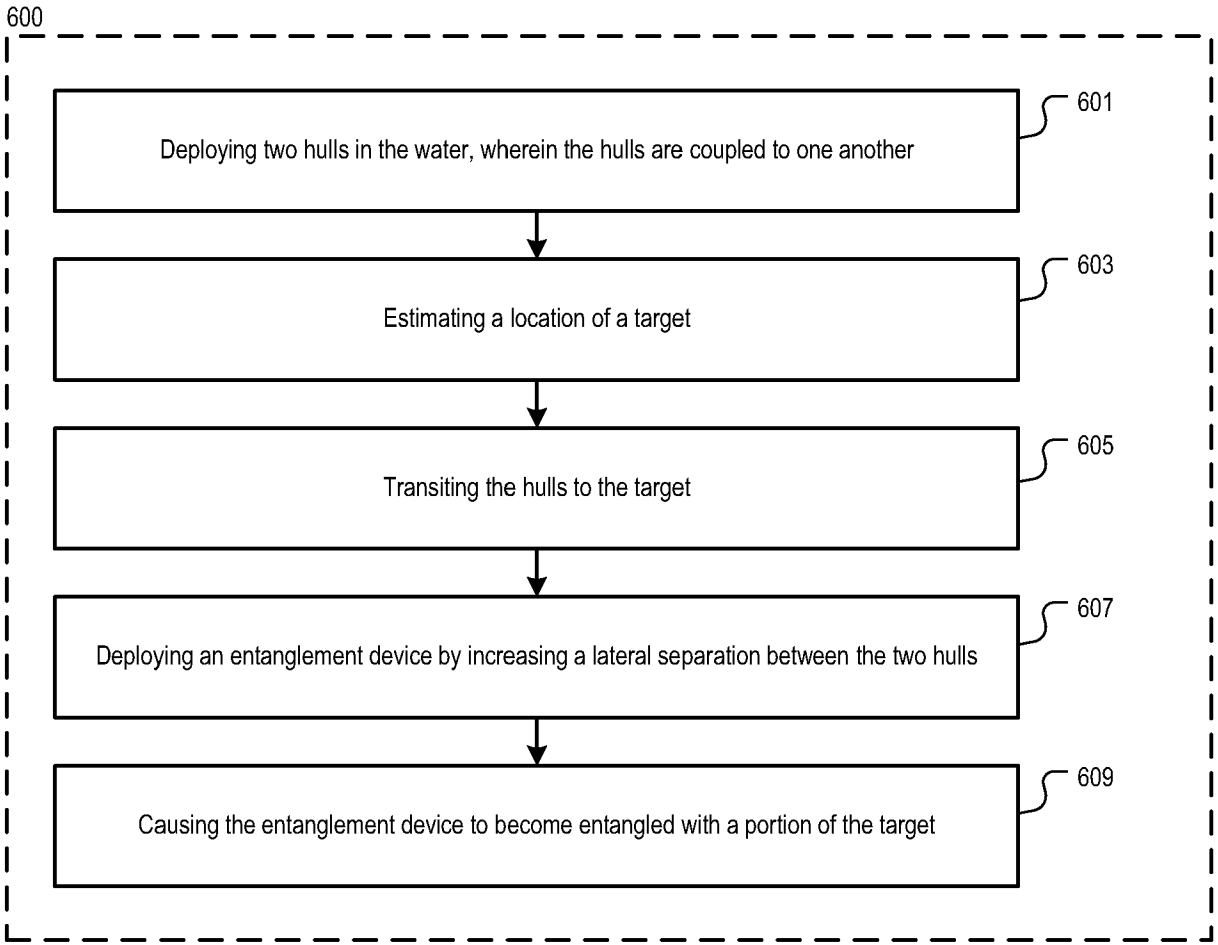
FIG. 6 depicts a method for disabling small watercraft in accordance with the illustrative embodiment of the present invention.

FIG. 3A depicts system 300 fully submerged, which is optional if not preferable when transiting to a target (see, e.g., FIG. 6: operation 605 of method 600). FIG. 3B depicts system 300 with hulls 302A and 302B and entanglement device 108 floating.

Figure 4A:
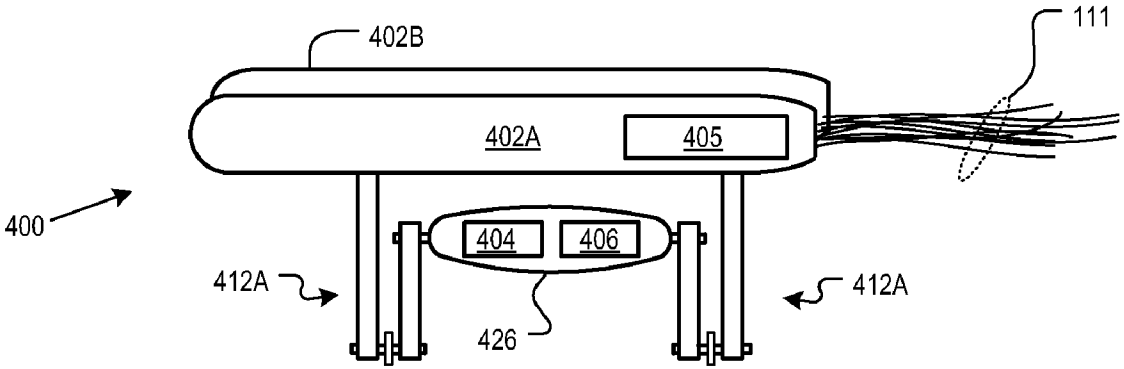
FIGS. 4A-4B depict a second alternative embodiment of system 100.
Figure 4B:
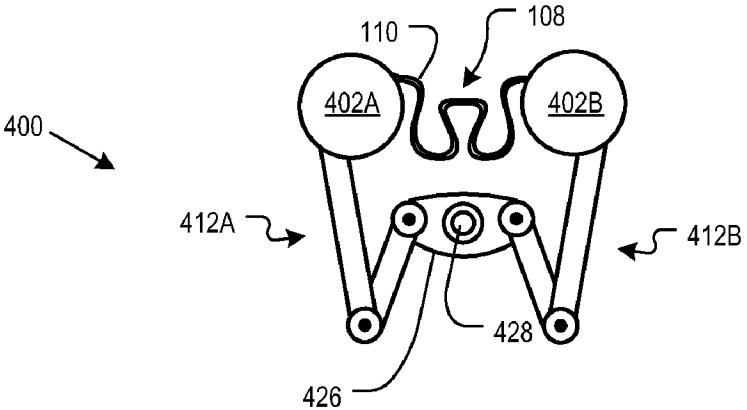

FIGS. 4A and 4B depict system 400, which is a second alternative embodiment of system 100 depicted in FIG. 1. A first primary difference between system 400 and system 300 is that in system 400, neither hull 402A nor hull 402B is a propulsion hull. Rather, secondary hull 426 is a propulsion hull.

Referring now to FIGS. 4A and 4B, FIG. 4A depicts a side view of system 400 with entanglement device 108 not deployed and FIG. 4B a rear view with system 400 in the same state as in FIG. 4A. For clarity, streamers 111 are not depicted in FIG. 4A.

System 400 comprises hulls 402A and 402B, secondary hull 426, two sets each of linkages 412A and 412B, and entanglement device 108, interrelated as shown.

Linkages 412A and 412B function in the manner of linkages 312A and 312B, previously described. Hulls 402A and 402B depth-control subsystem 405 (e.g., ballasting system, etc.). Homing, guidance, and control subsystem 104, and propulsion subsystem 106 are disposed in secondary hull 426.

Figure 5:
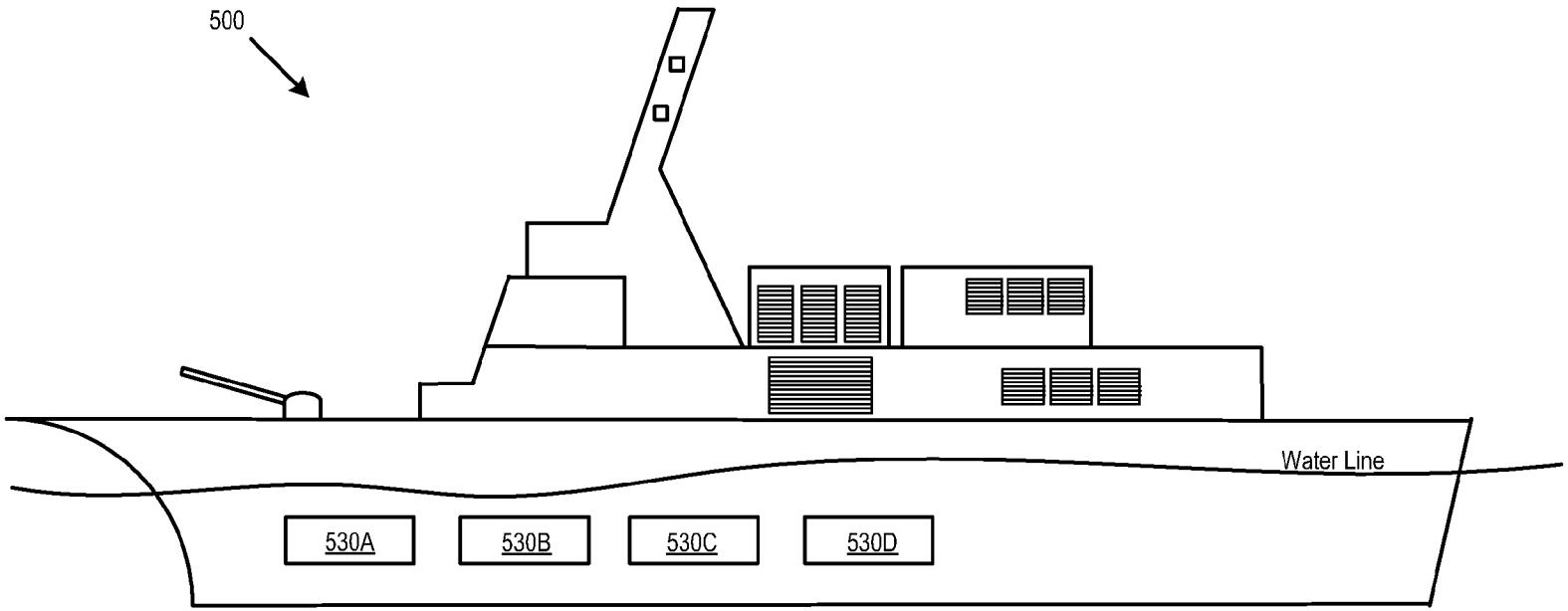
FIG. 5 depicts a mother ship having under-the-waterline bays for deploying a system for disabling small watercraft in accordance with the illustrative embodiment of the present invention.

FIG. 5 depicts mother ship 500. The mother ship includes under-the-waterline bays 530A, 530B, 530C, and 530D for stowing any of systems 100, 300, or 400 disclosed herein. In a threat condition, one or more of these systems can be deployed from ship 500 without alerting a target of the release.

It is to be understood that the disclosure teaches just one example of the illustrative embodiment and that many variations of the invention can easily be devised by those skilled in the art after reading this disclosure and that the scope of the present invention is to be determined by the following claims.

What is claimed is:

1. A system for disabling a small watercraft, the system comprising:

a first hull and a second hull, wherein a separation distance between the first and second hull is changeable;

a first propulsion subsystem for moving the first hull and the second hull through water;

a first depth-control subsystem that enables the first hull and the second hull to change depth to achieve a first state or a second state, wherein, in the first state, the first and second hulls are submerged and in the second state the first and second hulls are floating;

a first homing, guidance, and control subsystem for acquiring a target and for directing the first propulsion subsystem to move the first and second hulls to the target; and an entanglement device that entangles the target, thereby disabling the target, wherein a first portion of the entanglement device physically couples to the first hull and a second portion of the entanglement device physically couples to the second hull.

2. The system of claim 1 wherein the entanglement device comprises a net having a monofilament construction.

3. The system of claim 2 wherein a plurality of strands of filament extend from the net.

4. The system of claim 1 wherein the first homing, guidance, and control subsystem comprises acoustic sensors for acquiring the target.

5. The system of claim 1 wherein the first depth-control subsystem comprises a ballasting system.

6. The system of claim 1 wherein the entanglement device disables a propulsion system of the target.

7. The system of claim 1 wherein the first hull is a first autonomous underwater vehicle, wherein the first propulsion subsystem is disposed in the first autonomous underwater vehicle.

8. The system of claim 7 wherein the second hull is a second autonomous underwater vehicle comprising a second propulsion subsystem.

9. The system of claim 1 further comprising:

a third hull;

a first linkage, wherein the first linkage is movable and couples the first hull to the third hull;

a second linkage, wherein the second linkage is movable and couples the second hull to the third hull; and at least a first mechanism that moves the first linkage and the second linkage, wherein movement of the first linkage and the second linkage changes the separation distance between the first hull and the second hull.

10. The system of claim 9 wherein the first homing, guidance, and control subsystem is disposed in the third hull.

11. The system of claim 9 wherein the first propulsion system is disposed in the third hull.

12. A method for disabling a small watercraft comprising:

deploying two hulls in water, wherein the two hulls are submerged under the water;

estimating a location of a target;

transiting the two hulls to the target;

deploying an entanglement device, wherein a first portion of the entanglement device couples to one of the two hulls and a second portion of the entanglement device couples to the other of the two hulls; and disabling the target by entangling the entanglement device with the target.

13. The method of claim 12 wherein the operation of deploying an entanglement device further comprises increasing a separation distance between the two hulls.

14. The method of claim 12 wherein the operation of transiting further comprises surfacing the two hulls proximal to the target.

15. The method of claim 12 wherein the operation of disabling further comprises entangling the entanglement device with a propeller of the target.

16. A method for disabling a small watercraft comprising:

deploying two hulls in water;

estimating a location of a target;

transiting the two hulls to the target;

deploying an entanglement device, wherein a first portion of the entanglement device couples to one of the two hulls and a second portion of the entanglement device couples to the other of the two hulls; and disabling the target by entangling the entanglement device with a propeller of the target.

17. The method of claim 16 wherein the operation of deploying further comprises submerging the two hulls in the water.

18. The method of claim 17 wherein the operation of transiting further comprises surfacing the two hulls proximal to the target.

19. The method of claim 16 wherein the operation of deploying an entanglement device further comprises increasing a separation distance between the two hulls.

* * * * *